US008408112B2

(12) United States Patent
Keska

(10) Patent No.: US 8,408,112 B2
(45) Date of Patent: Apr. 2, 2013

(54) TRIMMING AND SIZING DEVICE TO REFURBISH EMPTY CARTRIDGE CASES AND A METHOD TO REFURBISH EMPTY CARTRIDGE CASES

(76) Inventor: Wojtek Keska, Wallenhorst (DE)

( * ) Notice: Subject to any disclaimer, the term of this patent is extended or adjusted under 35 U.S.C. 154(b) by 0 days.

(21) Appl. No.: 13/026,253

(22) Filed: Feb. 13, 2011

(65) Prior Publication Data

US 2011/0232467 A1 Sep. 29, 2011

(30) Foreign Application Priority Data

Mar. 23, 2010 (DE) ..... 10 2010 012 293
Oct. 15, 2010 (DE) ..... 10 2010 048 117

(51) Int. Cl.
*F42B 33/10* (2006.01)

(52) U.S. Cl. ..... 86/24

(58) Field of Classification Search ..... 86/24, 19.7, 86/23, 33, 37, 40, 28, 10, 12, 18, 19.5, 54, 86/19.6, 32
See application file for complete search history.

(56) References Cited

U.S. PATENT DOCUMENTS 3,174,390 A 3/1965 Jacobsen
3,555,641 A 1/1971 Lee
4,325,282 A 4/1982 Schaenzer
5,125,316 A 6/1992 Markle
5,309,813 A 5/1994 Henley
5,635,661 A 6/1997 Tuftee
5,649,465 A 7/1997 Beebe
6,101,915 A 8/2000 Sinclair
7,650,825 B1 1/2010 Lee

OTHER PUBLICATIONS

Office Action of the German Patent and Trademark Office (DPMA) indicating that the counterpart application there is now provisionally patentable, subject to a few further formalities that are listed.

*Primary Examiner* — Michael Carone
*Assistant Examiner* — Reginald Tillman, Jr.
(74) *Attorney, Agent, or Firm* — Michael Soderman

(57) ABSTRACT

A trimming, sizing and decapping device that has a simple, very compact construction and that allows the user to economically and quickly produce, restore or prepare cartridge cases to the utmost precision. The device consistently produces very smooth processing surfaces and has good tolerances with respect to various cartridge case wall sizes and materials. Furthermore, a method is detailed for producing or preparing empty cartridge cases using the trimming, sizing and decapping device that allows efficient preparation of the cartridge cases for subsequent loading or reloading in as few process steps as possible.

12 Claims, 2 Drawing Sheets

TRIMMING AND SIZING DEVICE TO REFURBISH EMPTY CARTRIDGE CASES AND A METHOD TO REFURBISH EMPTY CARTRIDGE CASES

CROSS REFERENCE TO RELATED APPLICATIONS

This application claims the benefit of priority under 35 U.S.C. §119 of German Patent Application DE 10 2010 012 293.9 filed on Mar. 23, 2010, the entire contents of which are incorporated herein by reference.

FIELD OF THE INVENTION

The invention relates to a device that can trim and size cartridge cases and a method for trimming and sizing cartridge cases.

BACKGROUND OF THE INVENTION

It is imperative to pay attention to accurate processing of each individual part and each cartridge when producing or rather restoring or preparing precision ammunition. Repeat accuracy must be guaranteed when producing and assembling the individual components. Precision cartridges demand high quality materials and the tightest of tolerances. That also applies to the cartridge case. It is a well-known fact that after cartridges are fired the cartridge cases exhibit an increased diameter along their entire length. The length of the cartridge case also changes, more specifically, it gets longer. In addition, it is also well known that cartridge cases become longer after being sized in a die body. The first requirement to fulfill when restoring fired cartridges is to restore the correct cartridge case dimensions.

At the present time several items of equipment are required to produce, restore or prepare cartridge cases as well as for renewed loading or reloading, for example:

Loading press
Die body
Primer puller
Case trimmer.

As a consequence, it has been necessary to undertake the following process steps to produce or restore/prepare cartridge cases for loading or reloading:

1. Prepare the cartridge case—clean
2. Adjust settings to the die body in a loading press
3. Insert the cartridge case into the case holder
4. Eject the primer
5. Press in the cartridge case (resize the external dimensions in the body of the die)
6. Remove the cartridge case from the body of the die
7. Size the neck of the cartridge case with the aid of an expander die
8. Sort according to length
9. Trim the cartridge case to predefined dimensions
10. Deburr the inside and outside edges of the cartridge case neck As is apparent from the above description the numerous different process steps to be completed one after the other to restore or prepare cartridge cases using a large variety of different devices represent a problem.

U.S. Pat. No. 5,309,813 describes a cartridge case processing device used in the reloading of cartridge cases. It puts the burden of positioning the top of the cartridge case on the guide member, however, so a guide member with a diameter that is slightly smaller than the internal diameter of the top of the cartridge case, or imprecise centering of the cartridge case as it comes up, could give rise to rough processing or damage. Also, the cartridge case is milled as it goes upward into the milling cutter, which could likewise bring about rough processing. The present invention consistently provides a clean, smooth, precise surface because the outer die provides a more secure guide and the milling is done after the case cartridge is stopped and in position, among other things.

A reforming die for cartridge cases is described in U.S. Pat. No. 5,635,661. It limits the lengthwise growth of the case neck during resizing with a stop surface, but this leads to imprecise and unpredictable results with regard to the cartridge case walls.

The results are much more dependent upon initial wall thickness, the physical characteristics of the metal, ambient conditions and other factors.

Other devices, for instance those described in U.S. Pat. No. 3,174,390, U.S. Pat. No. 3,555,641, U.S. Pat. No. 6,101,915 and U.S. Pat. No. 7,650,825, only carry out some of the steps, or only portions of steps, of the trimming, sizing and decapping process and require further work steps.

SUMMARY OF THE INVENTION

The present invention is a trimming and sizing device to refurbish empty cartridge cases as well as a method of preparing empty cartridge cases using such a trimming and sizing device. The sizing device has a die body into whose hollow chamber it is possible to insert an empty cartridge case, a case holder to fix the base of the cartridge case in position and an expander die that is inserted into the cartridge case from the bullet end; it is an embodiment of the invention that a decapping pin is accommodated in the expander die. According to the invention the expander die, the decapping pin and a cutter are mounted coaxially on a common shaft. In the embodiment of the method according to the invention the expander die is inserted into the hollow chamber of the die body so that pressing the cartridge case into the body of the die causes the primer to be ejected out of the base of the cartridge case whilst simultaneously sizing the outer jacket surface of the cartridge case in a single work step, because the decapping pin is a component of the expander die inserted into the cartridge case in this manner and is followed by trimming the bullet end of the cartridge case to the required length with the cutter, to subsequently achieve a resizing of the inner diameter of the tapered neck section of the cartridge case by withdrawing the cartridge case out of the body of the die.

DRAWINGS

Reference Numerals

Figure 1:
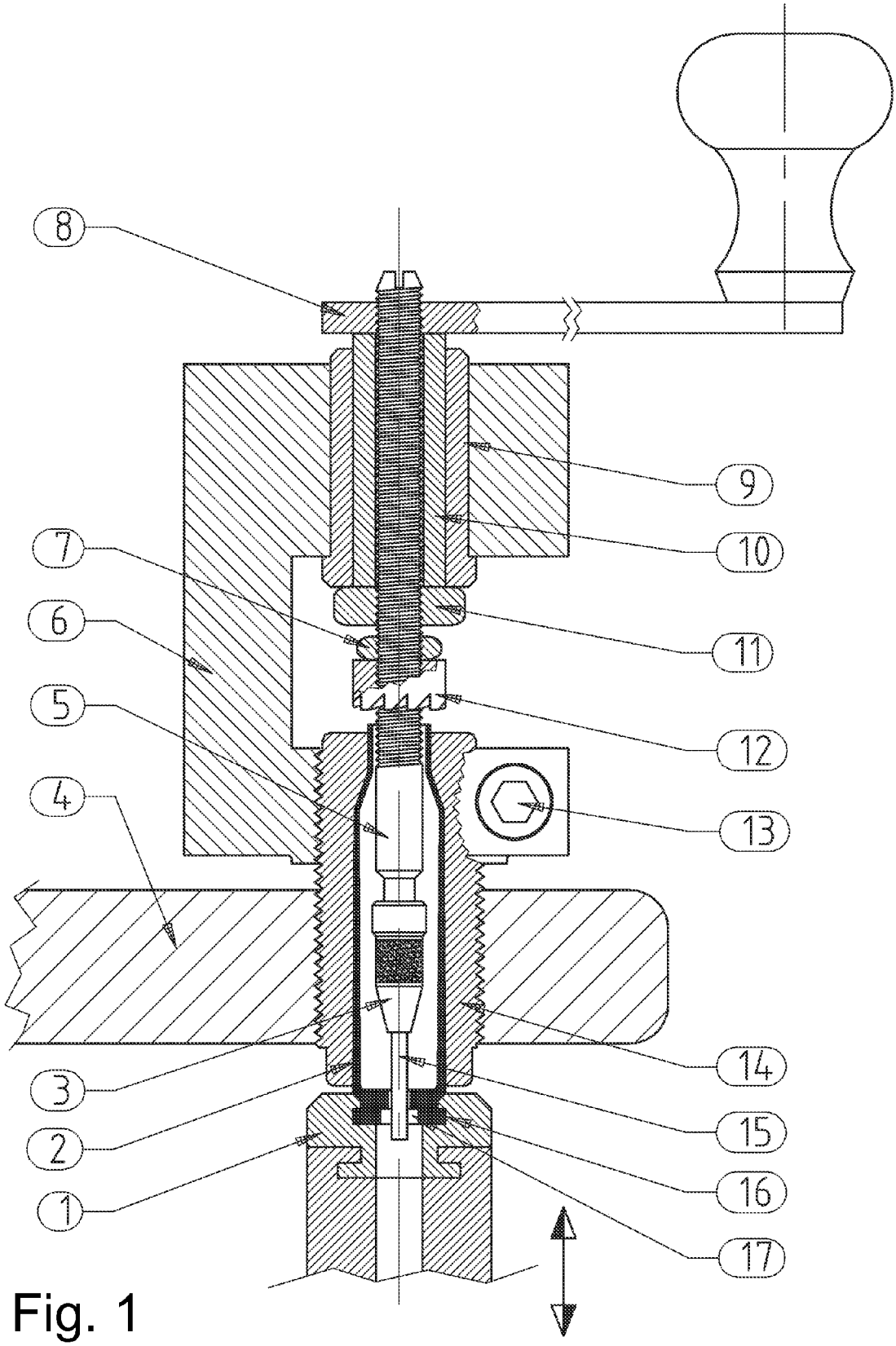
FIG. 1: A sectional view of a first embodied version of a trimming and sizing device according to the invention.

1. Case holder
2. Cartridge case
3. Expander die
4. Loading press
5. Threaded rod
6. Holder (threaded rod and body of die)

7. Lock nut (small)
8. Crank handle
9. Guide bushing
10. Bushing
11. Lock nut
12. Cutter
13. Clamping screw
14. Die body
15. Decapping pin
16. Base of cartridge case
17. Flash hole (of ejected primer)

DESCRIPTION OF THE PREFERRED EMBODIMENTS

The purpose of this invention is to make available a trimming and resizing device to prepare empty cartridge cases that has a simple, compact as possible construction and allows the user to economically and quickly produce, restore or prepare cartridge cases to the utmost precision.

Furthermore, a method is detailed for producing or preparing empty cartridge cases using the trimming and sizing device that allows efficient preparation of the cartridge cases for subsequent loading or reloading in as few process steps as possible. The invention solves this problem with the characteristic features of the separate patent claims 1 and 10. Further embodiments are the subject of the subsequent subordinate claims.

A trimming and sizing device according to the invention to refurbish empty cartridge cases by means of a die body into whose hollow chamber it is possible to insert a spent, empty cartridge case, a case holder to fix the base of the cartridge case in position and an expander die, which accommodates a primer decapping pin, that is inserted into the cartridge case from the bullet end of the cartridge case has been further developed according to the invention so that the expander die, the primer decapping pin and a cutter of the trimming and sizing device are mounted coaxially on a common shaft.

This solution has created a trimming and sizing device that is small, cost-effective and compact by design and facilitates the processing of empty cartridge cases to the highest precision in very little time and without requiring a great deal of preparation. According to the invention the trimming and sizing device combines several of the devices required to date in a single device. In doing so it makes it possible to eliminate several work process steps in comparison with methods known to date, because according to the invention the trimming and sizing device makes it possible to completely process the cartridge case in just a few process steps. The coaxial assembly of the expander die, decapping pin and the cutter mounted on the shaft makes it possible to trim and size the cartridge case to the correct and necessary dimensions in a single work process.

The nature of the invention is to trim the cartridge case after the expander die and the accommodated decapping pin have been inserted into the cartridge case in a process that sees the decapping pin eject the primer as the cartridge case is inserted into the body of the die. The precision of the inside diameter and the neck wall thickness of the cartridge case have a decisive influence on the reliability and accuracy of the bullet. For instance, if there is increased resistance as the result of a damaged inner jacket surface of the bullet side of the cartridge case the friction in this area changes so that the bullet is subjected to increased pressure when fired. This increased pressure results in an increased speed of the bullet, which has a huge influence on accuracy. Of particular significance here is the fact that the inner jacket surface of the cartridge case is sized, and in particular the neck area of the cartridge case, when the cartridge case is withdrawn from the body of the die and as a consequence is able to achieve a scratch and burr-free inside surface. This invention eliminates the damaging effect caused by trimming on the inner jacket surface, and in particular to the neck of the cartridge case, which represents a significant advantage of this solution, as this is of particular importance for the accuracy of precision bullets as used by sharpshooters and riflemen alike. The invention can be utilized for production with reloaders as well as for the industrial production of ammunition.

A first embodiment of the invention is that the shaft has, at least partially, a threaded section. This design characteristic makes it possible to mount the expander die, the decapping pin and the cutter of the trimming and sizing device on the same shaft, and that they can be moved relative to one another to suit requirements. Thus, the threaded section of the shaft also makes it possible to set the distances required between the components to ensure exact processing of the cartridge case.

A rotational movement of the shaft is required in particular to trim the length of the cartridge case. For this reason a preferred embodiment of the invention ensures it is possible to drive, in other words rotate, the shaft mechanically or manually.

A particularly simple design embodiment of the shaft drive comprises a crank handle to manually rotate the shaft. An electric motor is one possible example of a mechanized drive. This could be equipped with a micro switch that turns on the motor and then off again after the primer has been ejected but before the cartridge case has reached its end position in the body of the die or rather before the cartridge case is withdrawn.

As previously described the cutter is positioned and secured on the threaded section of the shaft. A lock nut, which is also positioned on the threaded section of the shaft, secures the cutter in a position that is to be seen as the preset trimming position for processing and producing the correct length of the cartridge case.

In addition to this first lock nut it can prove advantageous if there is a second lock nut on to the threaded section of the shaft This second lock nut also serves to ensure the correct spacing distances of the individual components of the trimming and sizing device in relation to one another and as a consequence represents a simple method of adjusting settings.

It is further suggested that a threaded joint is to be provided between a loading press and the body of the die and/or between a holder and the body of the die to facilitate coupling the trimming and sizing device according to the invention with, for example, a loading press or a holder. Consequently, it is possible to accommodate the body of the die in a holder and/or a loading press, which makes a significant contribution to the compactness of the overall trimming and sizing device.

A further embodiment according to the invention is to be seen in the body of the die being implemented as a single piece with a holder of the trimming and sizing device. This characteristic makes it possible to reduce the number of components even further, which leads to an overall simplification of the trimming and sizing device. The method according to the invention of producing or preparing empty cartridge cases with a previously described trimming and sizing device makes it possible, for example, to reuse cartridge cases and comprises a process in which the expander die accommodating decapping pin is inserted into the hollow chamber of the die body that causes the primer to be ejected from the base of the cartridge case by pressing the cartridge case into the body of the die whilst simultaneously sizing the outer jacket surface of the cartridge case in a single work step, because the decapping pin is a component part of the expander die inserted into the cartridge case in this manner and is followed by trimming the bullet end of the cartridge case to the required length with the cutter, to subsequently achieve a resizing of the inner diameter of the tapered neck section of the cartridge case with the expander die by withdrawing the cartridge case out of the body of the die.

The process according to the invention makes it possible to reduce the complex and numerous process steps already mentioned at the beginning to a minimum, and as a consequence it is possible to complete these within a shorter timeframe. Thus, the new process is significantly more efficient, precise, time-saving and cost effective than known solutions. It is possible to utilize the process for industrial production purposes as well as in the private sector to process empty cartridge cases in preparation for loading and reloading. The nature of the invention is to eliminate several of the processing steps required to date to produce, restore or prepare cartridge cases for loading or reloading, and as a consequence guarantee a better and quicker process. The one-off setting of the die body and the cutter eliminates the process of prechecking (sorting) the dimensions. Furthermore, the fact that time and energy can be saved by changing the order of the process steps when producing or restoring/preparing cartridge cases for loading or reloading is to be seen as a significant advantage. Moreover, it is no longer necessary to sort the cartridge cases.

Due to the change and reduction of process steps achieved according to the invention repeat processes, such as having to make individual settings for and clamp each individual cartridge case or deburr the inner and outer edges of the cartridge case neck after trimming, are now no longer necessary. A burr can, however, regularly be detected on the outer and/or the inner edge of the cartridge case neck, in other words the bullet end of the cartridge case. Of particular advantage, therefore, is a further development of the invention that sees any burr at the neck of the cartridge case removed or broken off at the same time as when the expander die is withdrawn from the cartridge case. The outer burr is removed by the contact or rather the friction between the edge of the cartridge case neck and the body of the die, and the inner burr is removed by the contact or rather the friction between the edge of the cartridge case neck and the expander die. This characteristic measure also eliminates an additional process step.

As previously described the shaft has a threaded section. Thus, consistent with a corresponding embodiment of the process according to the invention it is possible set the length achievable after trimming the cartridge case by means of a screwing motion of the body of the die held in the accommodating loading press, by changing the position of the cutter on the threaded section of the shaft or by changing the position of the holder in relation to the body of the die. Thus, according to the invention the trimming and sizing device makes possible several setting options and is as a consequence very flexible and easy to use.

In the following the invention is explained in more detail with reference to the accompanying drawings. The depicted examples of embodiment do not represent any limitation to the depicted versions, but serve solely to explain a principle of the invention. The same or similar components are indicated with the same reference numbers.

In order to be able to illustrate the mode of operation according to the invention highly simplified schematic representations only are depicted in the figures that do not include components of no essential significance to the invention. Nevertheless, that does not mean that such components are not present in a solution according to the invention.

FIG. 1 depicts a sectional view of a first embodied version of a trimming and sizing device. The more essential elements are a die body 14 with a hollow chamber into which it is possible to insert a cartridge case 2 precisely in a manner that the outer jacket surface of this cartridge case 2 is sized at the same time as when the cartridge case 2 is being inserted. The lower section of the cartridge case 2 is fixed in position by a case holder 1 into which the base 16 of the cartridge case 2 is detachably placed. Within the depicted cartridge case 2 there is an expander die 3 that accommodates a decapping pin 15, which ejects the primer of the cartridge case 2 when the expander die 3 and the cartridge case 2 are brought together. A flash hole 17 remains in the cartridge case 2 following this work step. The expander die 3 is a component of a shaft 5 that has a threaded section not described in more detail. In the first embodied version in FIG. 1 a cutter 12, a lock nut 7 as well as a lock nut 11 are also arranged on the threaded section. The lock nut 7 serves to set the trimmable length of the bullet side of the cartridge case 2. The lock nut 11 is available to set the expander die 3 accommodating the decapping pin 15; the lock nut 11 serves to limit the axial movement of the shaft 5 with the expander die 3 and the decapping pin 15 when ejecting the primer or rather the highest position of the decapping pin 15. The crank handle 8 on the other hand limits the lowest position of the cutter 12 when trimming the bullet side of the cartridge case 2. All told, the rotary shaft 5, which is made to rotate by turning the crank handle 8, is assembled inside a bushing 10 that in turn is assembled in a guide bushing 9. The guide bushing 9 is made of bronze. The shaft 5 and the guide bushing 9 are held in the upper part of a holder 6. The die body 14 is screwed into a thread in the lower part of the holder 6. A clamping screw 13 serves to squeeze together or loosen the holder 6 with a slot in this section so that it is possible to adjust the position of the die body 14 in the holder 6 via its thread. The special advantage of the solution according to the invention is shown by the fact that the complete trimming and sizing device has a very compact construction and is a component of a loading press 4.

Figure 2:
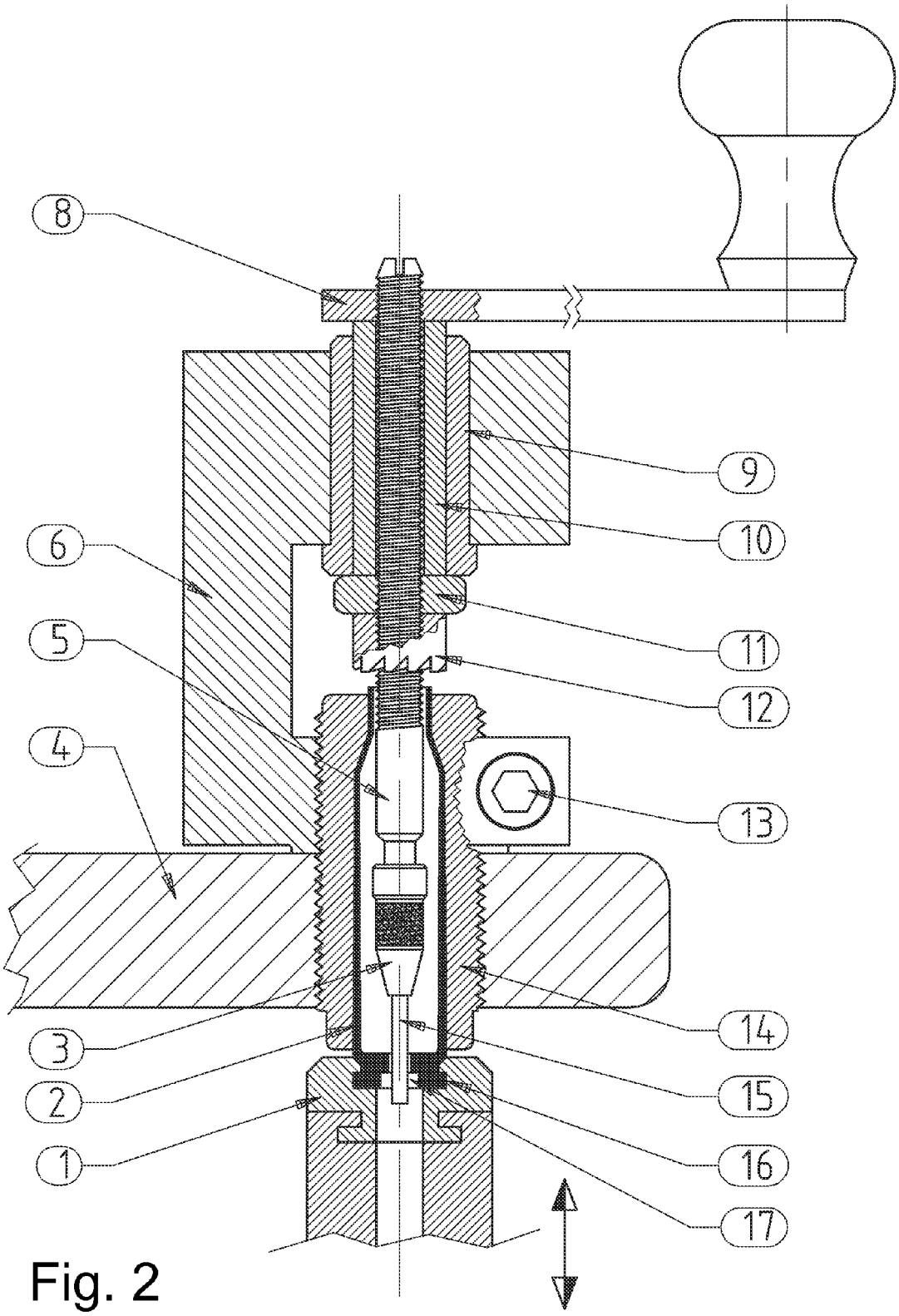
FIG. 2: A sectional view of a further embodied version of a trimming and sizing device according to the invention.

The embodied version in FIG. 2 is identical to the version in FIG. 1 with the exception that there is a lock nut 11 screwed onto the threaded section of the shaft 5. The trimming and sizing device is assembled by fitting the cutter 12, the expander die 3, the decapping pin 15 and the die body 14 onto the shaft 5.

After the expander die 3 and the accommodated decapping pin 15 are inserted the cartridge case 2 is inserted into the body of the die 14 and sized simultaneously, which means the outer jacket surface is resized to the required dimensions. The decapping pin 15 ejects the primer when the cartridge case 2 and the expander die 3 are brought together. To trim the cartridge case 2 to the correct length the user then turns the crank handle 8 a couple of times to turn the shaft 5 and the cutter 12, the decapping pin 15 and the expander die 3. Then the user withdraws the cartridge case 2 from the body of the die 14. During this process the expander die 3 sizes the neck of the cartridge case 2, into which the bullet is later added, and simultaneously removes or breaks off any burrs at the cartridge case neck.

What is claimed is:

1. A trimming and sizing device designed to refurbish empty cartridge cases (2) comprising a die body (14), fitting the form of the cartridge case, into whose hollow chamber it is possible to insert an empty cartridge case (2), a case holder (1) to fix the base (16) of the cartridge case (2) in position, and an expander die (3) which accommodates a primer decapping pin (15) that is insertable into the cartridge case (2) from the bullet end of the cartridge case (2), characterized in that the die body (14) securely guides and then tightly holds the top and sides of the cartridge case (2) in place after insertion and that the expander die (3), the primer decapping pin (15) and a cutter (12) of the trimming and sizing device are mounted coaxially on a common shaft (5) and are commonly movable in the axial and rotational directions of the shaft (5).

2. Trimming and sizing device according to claim 1, characterized in that the shaft (5) has, at least partially, a threaded section.

3. Trimming and sizing device according to claim 1, characterized in that the shaft (5) can be mechanically or manually driven.

4. Trimming and sizing device according to claim 3, characterized in that the shaft (5) has a crank handle (8) to drive (rotate) the shaft (5) manually.

5. Trimming and sizing device according to claim 2, characterized in that the cutter (12) is screwed onto the threaded section of the shaft (5) and secured by means of a lock nut (7) on the shaft (5).

6. Trimming and sizing device according to claim 5, characterized in that there is a second lock nut (11) on the threaded section of the shaft (5).

7. Trimming and sizing device according to claim 1, characterized in that there is a threaded joint between a loading press (4) and the body of the die (14) and/or between a holder (6) and the form-fitting die body (14).

8. Trimming and sizing device according to claim 1, characterized in that the die body (14) is constructed in one piece with a holder (6) of the trimming and sizing device.

9. Trimming and sizing device according to claim 1, characterized in that the die body (14) can be replaced to change the caliber size.

10. Method to produce or prepare empty cartridge cases with a trimming and sizing device according to claim 1, characterized in that the expander die (3) is inserted into the hollow body of the die (14) so that pressing the cartridge case (2) into the body of the die (14) causes the outer walls of the cartridge case (2) to be pressed against the inner walls of the die body (14) as a mold and the primer to be ejected out of the base (16) of the cartridge case (2) whilst simultaneously sizing the outer jacket surface of the cartridge case (2) in a single work step, because the decapping pin (15) is a component of the expander die (3) inserted in this manner into the cartridge case (2), and this is followed by trimming the bullet end of the cartridge case (2) to the required length with the cutter (12), to subsequently achieve a resizing of the inner diameter of the tapered neck section of the cartridge case (2) with the expander die (3) by withdrawing the cartridge case (2) out of the body of the die (14).

11. Method according to claim 10, characterized in that when withdrawing the expander die (3) out of the cartridge case (2) any burr at the neck of the cartridge case (2) is removed or rather broken off.

12. Method according to claim 10, characterized in that it is possible to set the length achievable by trimming the cartridge case (2) by means of a screwing motion of the body of the die (14) held in the accommodating loading press (4), by changing the position of the cutter (12) on the threaded section of the shaft (5) or by changing the position of the holder (6) in relation to the body of the die (14).

* * * * *